United States Patent [19]

Kolwaite

[11] 4,126,863

[45] Nov. 21, 1978

[54] TWO PIECE PORTABLE RADIO CABINET HINGED ABOUT ANTENNA

[75] Inventor: John S. Kolwaite, Dewitt, N.Y.

[73] Assignee: General Electric Company, Syracuse, N.Y.

[21] Appl. No.: 828,805

[22] Filed: Aug. 29, 1977

[51] Int. Cl.[2] ..... H01Q 1/24

[52] U.S. Cl. ..... 343/702; 325/354

[58] Field of Search ..... 343/702, 872; 325/354

[56] References Cited

U.S. PATENT DOCUMENTS 2,315,315 3/1943 Cairnes ..... 325/354

2,388,567 11/1945 Patterson ..... 343/702

*Primary Examiner*—Eli Lieberman

*Attorney, Agent, or Firm*—Carlos Nieves; George R. Powers; Leonard J. Platt

[57] ABSTRACT

A two piece portable radio cabinet having an economical hinged construction whereby convenient access is provided to the battery compartment without the need to disassemble the cabinet. The cabinet front piece supports the radio chassis, antenna and battery, the antenna serving as a rod about which the cabinet back piece pivots for closing and opening the cabinet.

5 Claims, 3 Drawing Figures

TWO PIECE PORTABLE RADIO CABINET HINGED ABOUT ANTENNA

BACKGROUND OF THE INVENTION

Portable radio cabinets usually provide access to the battery compartment through a battery door located on a surface of the cabinet, such as the cabinet back. These doors are primarily a separable piece commonly held in place by friction type or screw fasteners. With this construction, the door is subject to becoming lost or broken when it is removed for replacement of the batteries, or should it be inadvertently dislodged from its place. Alternatively, the entire cabinet back may be a separable piece removable in this manner, with the same disadvantages applicable in respect to the back becoming misplaced or broken.

Some portable cabinet designs provide for the battery door to be attached to the cabinet by hinges. However, all known designs of this type require additional parts in the formation of the hinge and thereby increase the cost of the structure.

SUMMARY OF THE INVENTION

It is accordingly an object of the invention to provide a portable radio cabinet of relatively simple, integral construction that permits convenient access to the battery compartment and does not require the battery compartment door to be a separable piece.

It is a further object of the invention to provide a portable radio cabinet as above described having a hinged construction for the battery door of a type that does not require additional parts.

These and other objects of the invention are accomplished by a portable radio cabinet composed of a cabinet front piece which supports the radio chassis, a rod antenna and a battery, and a cabinet back piece which completes the cabinet enclosure. The antenna is employed in a dual capacity. In addition to picking up received signals it also serves as a rod about which the back piece is hinged for opening and closing of the cabinet to thereby provide ready access to the battery compartment. The antenna rod is held in place along one side of the cabinet front at a minimum of two fixed points to securely position the antenna. A side of the cabinet back that is intended to mate with said one side of the cabinet front is hinged onto the antenna rod at a minimum of two pivot points for providing rotation of the cabinet back about the antenna, said pivot points being spaced apart by an amount sufficient to resist rotation of the back piece about axes perpendicular to that of the antenna. In accordance with a preferred embodiment, the cabinet front has a pair of spaced apart apertured members which project out from said one side thereof. The corresponding side of the cabinet back has a second pair of spaced apart apertured members, the first and second pair of apertured members being fitted together with their apertures in alignment. The antenna extends through the apertures of said members and is secured at its base to the cabinet front.

BRIEF DESCRIPTION OF THE DRAWING

While the specification concludes with the claims which particularly point out and distinctly define that subject matter which is regarded as the invention, it is believed the invention will be more clearly understood when considering the following detailed description and the accompanying figures of the drawing in which:

DESCRIPTION OF THE PREFERRED EMBODIMENT

Figure 1:
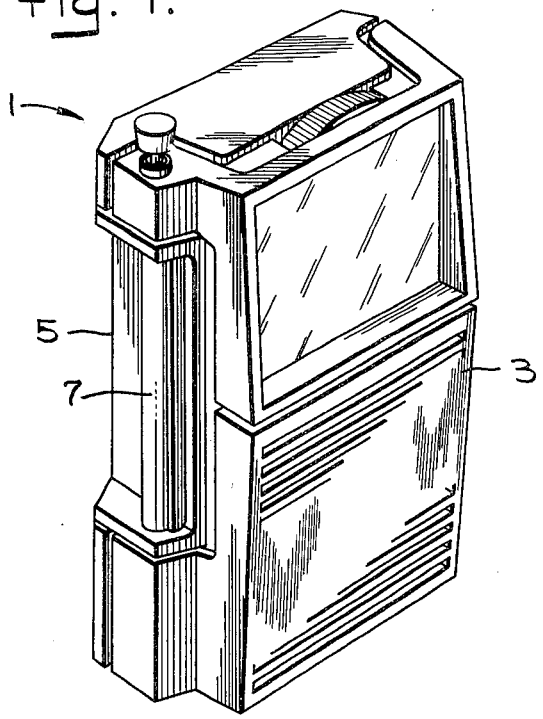
FIG. 1 is a perspective view of a portable radio cabinet in its closed position, in accordance with the invention.

Referring to FIG. 1, there is illustrated a perspective view of a portable radio cabinet 1, in which the cabinet front piece 3 and cabinet back piece 5 are integrally coupled together by means of a hinged construction to provide easy opening and closing of the cabinet and ready access to the battery compartment. A rod antenna 7 is employed in dual capacity, serving in the conventional manner to pick up radiated broadcast signals and also serving as a rod about which the cabinet back and front pieces are pivoted relative to each other.

Figure 3:
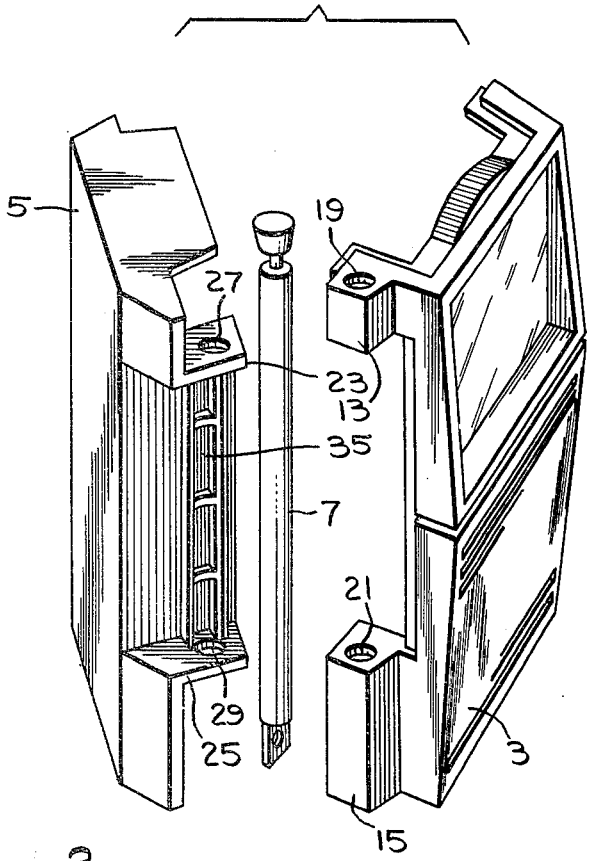
FIG. 3 is an exploded perspective view of the portable radio cabinet.
Figure 2:
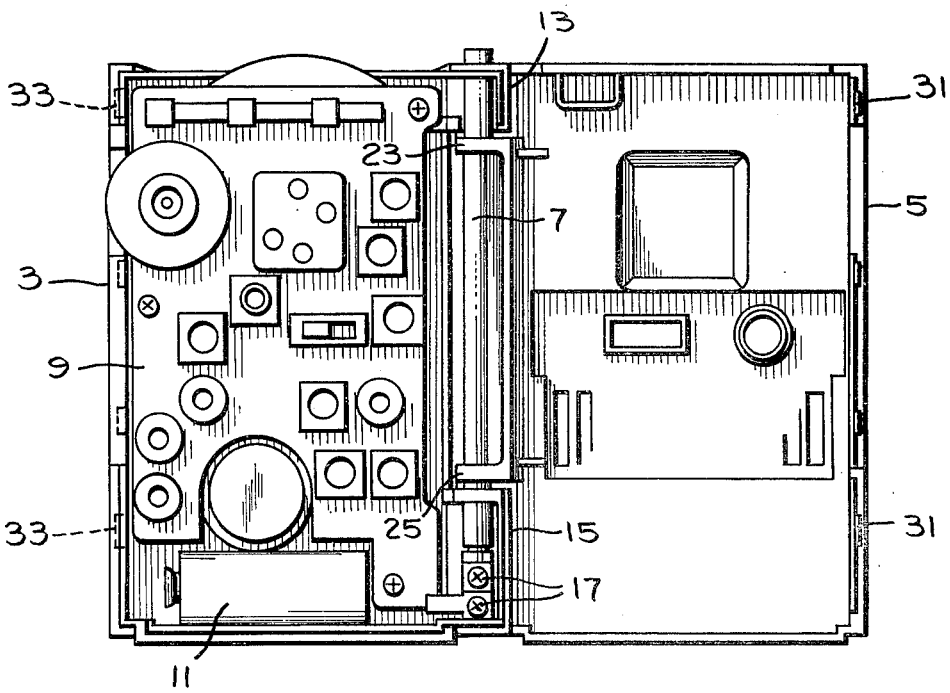
FIG. 2 is a plan view of the inside surfaces of the portable radio cabinet in its open position.

The hinged construction is shown in additional detail in the plan and exploded perspective views of FIGS. 2 and 3, respectively. As seen in FIG. 2, the cabinet front 3 has supported thereon the radio chassis 9, which includes a printed circuit board and the various radio circuit components, a battery 11 and the antenna rod 7. The antenna rod is supported at one side of the cabinet front by a pair of projections 13 and 15, and is fastened at its base to the cabinet front by means of screws 17. The cabinet front projection 13 and 15 each have an aperture 19 and 21, respectively, for containing the antenna, shown in FIG. 3.

At the corresponding side of the cabinet back 5 that is hinged about the antenna 7 there are provided a pair of rib members 23 and 25 each of which have an aperture 27 and 29, respectively. When the projections 13 and 15 and rib members 23 and 25 are fitted together their apertures are in alignment to permit the antenna 7 to extend therethrough. The rib members provide rotation of the cabinet back about the antenna to permit ready opening and closing of the cabinet. A plurality of tabs 31 on the side of the cabinet back opposite the antenna engage a plurality of indentations 33 on the corresponding side of the cabinet front to provide a friction lock of the cabinet in its closed position. The rib members 23 and 25 are spaced apart by an amount sufficient to resist rotation of the cabinet back about axes perpendicular to that of the antenna. The rib members are joined by a channel member 35 in which the antenna lies that aids the rotational motion of the cabinet back about the antenna and further resists rotation around other axes.

What I claim as new and desire to secure by Letters Patent of the United States is:

1. A portable radio cabinet comprising:

(a) a first cabinet piece, (b) a rod antenna, (c) first means for securing said antenna to said first cabinet piece at a minimum of two fixed points, (d) a second cabinet piece, and (e) second means for hinging said second cabinet piece onto said antenna at a minimum of two pivot points, said pivot point being spaced apart so as to provice rotation of said second cabinet piece about said antenna and to resist rotation about other axes perpendicular to that of said antenna.

2. A portable radio cabinet as in claim 1 wherein said first means includes a pair of apertured projections at one side of said first cabinet piece, and said second means includes a pair of apertured rib members at a corresponding side of said second cabinet piece, said projections and rib members being fitted together with their apertures in alignment and said antenna extending through said apertures.

3. A portable radio cabinet as in claim 2 wherein said apertured rib members are joined by a channel member in which said antenna lies that aids rotational motion of the second cabinet piece about said antenna and further resists rotation about said other axes.

4. A portable radio cabinet as in claim 3 wherein said first means further includes means for securing the base of said antenna to said first cabinet piece.

5. A portable radio cabinet as in claim 4 wherein said first cabinet piece comprises the cabinet front and said second cabinet piece comprises the cabinet back.

* * * * *